US005396661A

United States Patent [19]

Sutter et al.

[11] Patent Number: 5,396,661

[45] Date of Patent: Mar. 14, 1995

[54] HELMET VISOR OPERATING MECHANISM

[75] Inventors: Brad L. Sutter, Duryea; Francis J. Kuna, Carbondale; John B. Arnaiz, Clark Summit, all of Pa.

[73] Assignee: Gentex Corporation, Carbondale, Pa.

[21] Appl. No.: 161,725

[22] Filed: Dec. 3, 1993

[51] Int. Cl.[6] ..... A42B 3/02

[52] U.S. Cl. ..... 2/6.5; 2/6.4

[58] Field of Search ..... 2/6.5, 6.4, 6.3, 424, 2/10, 8

[56] References Cited

U.S. PATENT DOCUMENTS 4,170,792 10/1979 Higgs ..... 2/6.5 X
4,621,377 11/1986 Pennell ..... 2/6.4
4,907,300 3/1990 Dampney ..... 2/6.5 X

*Primary Examiner*—Peter Nerbun

*Attorney, Agent, or Firm*—Shenier & O'Connor

[57] ABSTRACT

A helmet visor operating mechanism in which springs urge the rolling elements of respective pairs of rolling elements toward relatively smaller radial dimension spaces between a brake ring carried by the visor and an axle carried by the helmet shell to lock the visor against movement toward its raised position and against movement toward its lowered position. Respective actuators mounted for rotary movement on the axle have pairs of tangs extending into the space between the axle and the ring and between the rolling elements of the respective pairs. Outwardly extending tabs can be squeezed together to cause the tangs to move the rolling elements of the pairs away from each other against the action of the springs to unlock the visor and permit it to be raised or lowered by subsequent movement of the tabs in the same direction.

14 Claims, 2 Drawing Sheets

HELMET VISOR OPERATING MECHANISM

FIELD OF THE INVENTION

The invention is in the field of helmet visor operating mechanisms and, more specifically, it relates to an improved helmet visor operating mechanism which overcomes the defects of operating mechanisms of the prior art.

BACKGROUND OF THE INVENTION

Protective helmets worn by pilots are generally provided with one or more visors which can be moved between lowered positions in front of the wearer's eyes and raised positions clear of his field of vision. Many and various mechanisms are known in the prior art for actuating helmet visors to permit the visor to be held in discrete positions between the raised and lowered positions. Other assemblies permit the visor to be moved into and held in any position intermediate to the raised and lowered positions.

Higgs U.S. Pat. No. 4,170,792 shows a mechanism which is especially adapted for use in connection with the visors on a pilot's helmet or the like. More particularly, it shows an arrangement in which a clutch output member carried by the visor is rotatably supported on a cylindrical boss secured to the helmet shell. A cutout in the clutch output member receives a pair of rollers which are urged by respective springs toward the central reduced diameter portion of the cutout to wedge the rollers between the boss and the clutch output member. A knob rotatably supported on the boss carries a clutch release element of tang disposed between the rollers and adapted to be moved into engagement with one or the other of the rollers to move it against the action of its spring to a relatively larger diameter portion of the cutout to release the visor for movement with the knob to an adjusted position in which it is again locked by the rollers.

While the arrangement shown in Higgs provides infinite adjustment of the position of the visor and a relatively positive locking action, the operation of the device is not as smooth as is desirable. More specifically, if the visor is in the up position and a person wearing the helmet actuates the knob to move the visor down, after the roller which had been holding the visor in the up position is moved to the release position, the weight of the visor itself causes the visor to get ahead of the wearer's movement of the knob so that the visor moves down in a number of steps. Stated in another way, in the course of the wearer's movement of the knob from the up position to the desired down position, the visor falls down a short distance under the action of gravity, is locked again, is unlocked, and moves down another short distance under the influence of gravity until it finally stops in the desired down position. Clearly, this operation is undesirable.

Application Ser. No. 07/766,754 of Hedges et al filed Sep. 27, 1991, now U.S. Pat. No. 5,230,101 discloses an arrangement for overcoming the problem discussed above. In the structure disclosed therein, each of the visor assemblies is provided with a drag ring which prevents the irregular movement of the visor in going to the down position, as discussed hereinabove.

Mechanisms of the type shown in the Higgs patent and in the Hedges et al application have the advantage that any force exerted directly on the visor only increases the force with which the locking roller or rollers is wedged. Thus any force, such as windblast encountered by the visor, only results in the visor being locked more securely.

It has now been discovered that mechanisms of the type described hereinabove incorporate another defect. As has been pointed out hereinabove, mechanisms of this type lock tighter and tighter in response to an opposing force such as occasioned by windblast and the like. While this function itself is desirable, it results in what is at least an inconvenience to the user in that a variable force may be required to unlock the mechanism and move the visor. For example, if an attempt is made to move the visor up by rotating the knob after the visor has been subjected to windblast in the up direction, the force with which the roller is wedged is so great that the force exerted by the actuator or tang on the roller merely tends to drag everything along, including the visor. This tendency can be overcome by holding the visor stationary or even moving it in the other direction while turning the knob. Clearly, such a two-handed operation is anathema to the pilot who has many other concerns to occupy him. Users such as aircraft pilots cannot develop a routine which would be instinctive. Stated otherwise, at high speeds and low altitude, the pilot has other things on his mind than the procedure which may be required to release the visor locking mechanism.

SUMMARY OF THE INVENTION

One object of our invention is to provide a helmet visor operating mechanism which overcomes the defects of operating mechanisms of the prior art.

Another object of our invention is to provide a helmet visor operating mechanism which is easily released from its locked position.

A further object of our invention is to provide a helmet visor operating mechanism in which the force required to release the mechanism does not change appreciably with operating conditions.

Yet another object of our invention is to provide a helmet visor operating mechanism which is simple in construction and in operation for the results achieved thereby.

Other and further objects will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENTS

Figure 1:
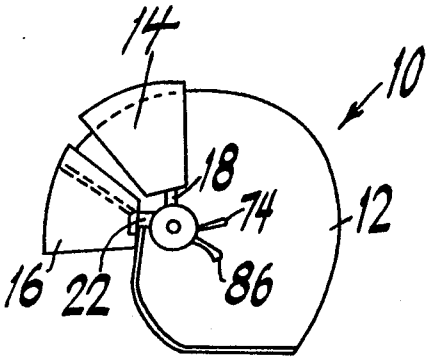
FIG. 1 is a side elevation of a helmet equipped with our helmet visor operating mechanism.

Referring now to the drawings, a helmet indicated generally by the reference character 10 which may be equipped with our helmet visor operating assembly, includes a helmet shell 12 carrying an outer visor 14 and an inner visor 16, each of which is adapted to be moved between a raised position out of the wearer's field of view and a lowered position in front of the wearer's eyes. Further, as is known in the art, one of the visors 14 and 16 normally is clear while the other is tinted.

The outer visor 14 is supported by a left-hand arm 18 and a right-hand arm 20. The inner visor 16 is supported by a left-hand arm 22 and a right-hand arm 24.

For purposes of simplicity, we will describe in detail only the mechanism indicated generally by the reference character 26 at the right-hand side of the shell 12 for supporting the outer visor for movement between the raised and lowered positions.

The inner visor right-hand arm 24 is provided with a hub 28 which is received by the inner visor support portion 30 of an axle having an outer visor support portion 32. Any suitable means, such for example as screws 34 secure the axle to the helmet shell 12.

The right-hand outer visor arm 20 is provided with a hub 36 which receives an outer brake ring 38. The ring 38 is mounted in the hub 36 for movement therewith.

Ring 38 is provided with three variable diameter inner surfaces 40, 42 and 44 separated by respective constant diameter inner surfaces 46, 48 and 50. Rollers 52 and 54 of a first pair of rollers are disposed respectively between the variable diameter inner surface 40 portion of the ring 38 and the outer surface of the outer visor axle portion 32 and between the variable diameter inner surface 42 of ring 38 and the outer surface of the outer visor axle portion 32. A spring 56 urges the rollers 52 and 54 apart toward the relatively smaller diameter portions of the surfaces 40 and 42 in a manner to be described more fully hereinbelow.

We position the rollers 58 and 60 of a second set of rollers respectively between surface 42 and the outer surface of axle portion 32 and between surface 44 and the outer surface of axle portion 32. A spring 62 normally urges the rollers 58 and 60 away from each other.

We position the rollers 64 and 66 of a third pair of rollers respectively between the surface 44 and the outer surface of axle portion 32 and between the surface portion 40 and the outer surface of axle portion 32. A spring 68 normally urges the rollers 64 and 66 away from each other.

Figure 3:
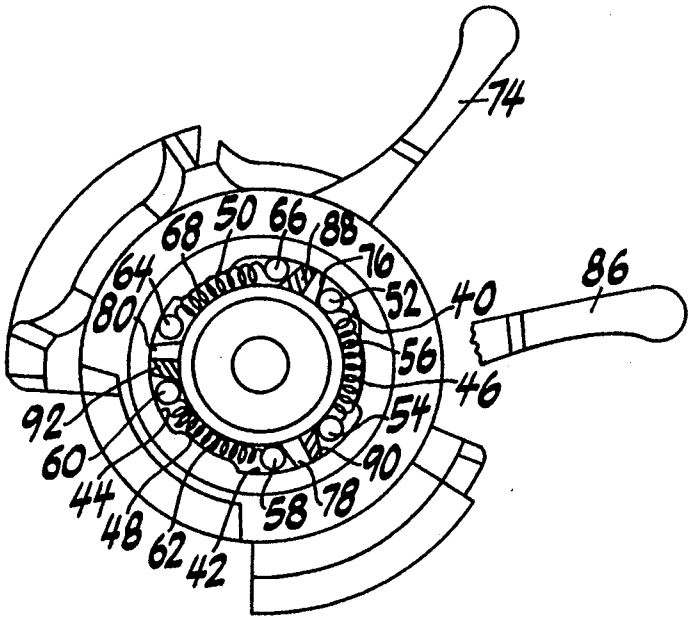
FIG. 3 is a plan illustrating the details of one form of our helmet visor operating mechanism.
Figure 5:
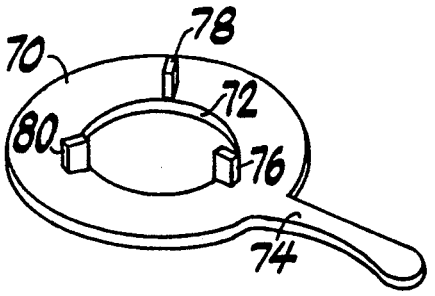
FIG. 5 is a plan of the other actuator of the form of our helmet visor operating mechanism shown in FIG. 3.

Referring now to FIG. 5, we provide the form of our helmet visor operating assembly shown in FIG. 3 with a first actuator 70 formed with a central opening 72 which permits the actuator to be mounted for rotary movement on the axle portion 32. Actuator 70 is provided with an arm 74 which is engaged by one of the wearer's fingers to release the mechanism in a manner to be described more fully hereinbelow. We provide the actuator 70 with three tangs 76, 78 and 80 at equally spaced locations around the central opening 72.

Our assembly includes a second actuator 82 formed with a central opening 84 which permits the actuator 82 to be mounted for rotary movement on the axle portion 32. An arm 86 adapted to be engaged by the wearer's thumb or finger, permits the actuator 82 to be rotated on the axle portion 32.

We form the actuator 82 with a plurality of tangs 88, 90 and 92 at equally spaced locations around the central opening 84.

Figure 2:
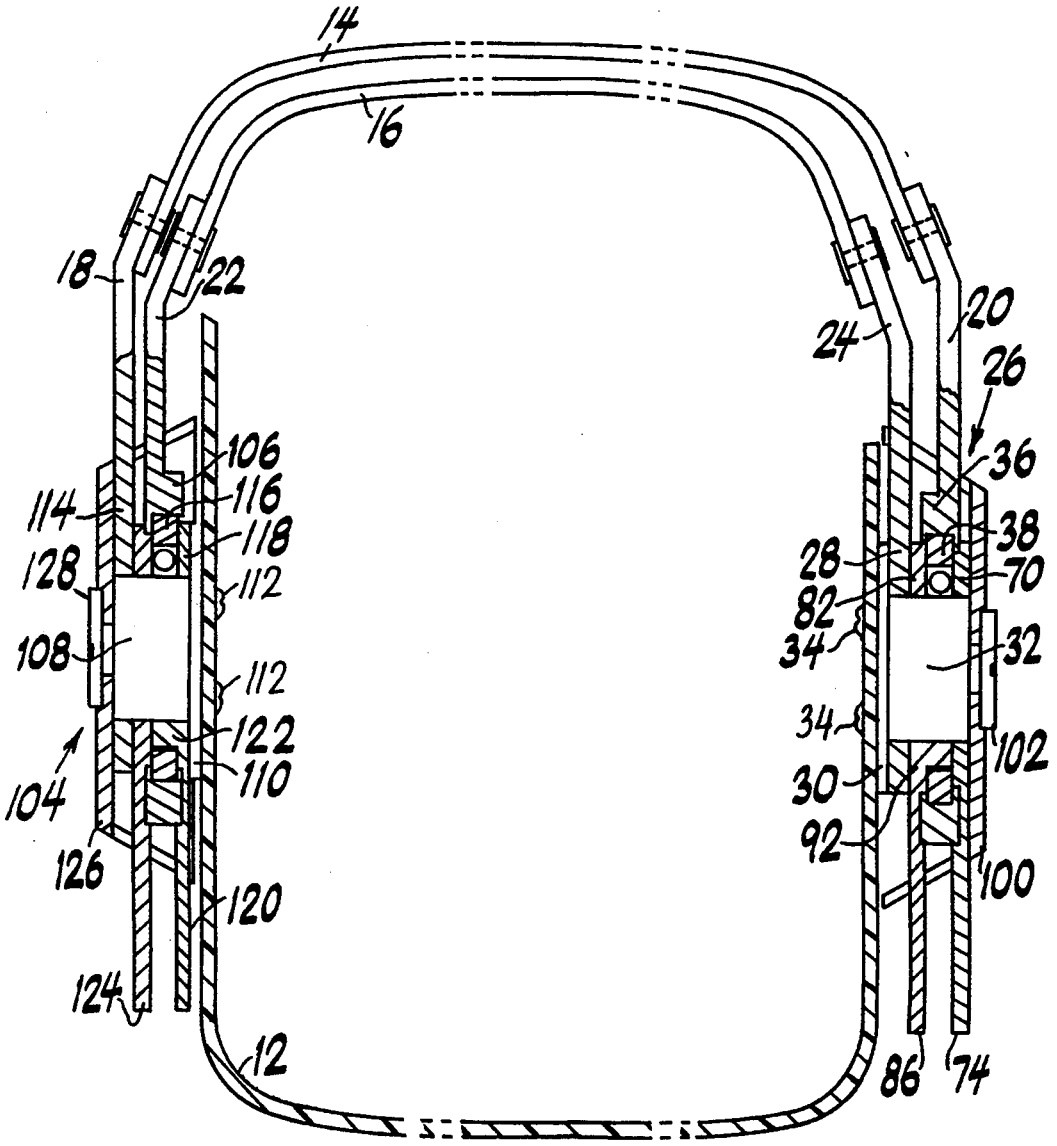
FIG. 2 is a sectional view of a helmet provided with our dual visor operating mechanism.

When the parts have been assembled, as shown in FIG. 2, with the actuator 82 inboard of the ring 38 and with the actuator 70 outboard of the ring 38, tangs 88, 90 and 92 extend outward into the spaces between the surface of axle portion 32 and the respective surfaces 40, 42 and 44. Tangs 76, 78 and 80 likewise extend inward into these spaces.

As can be seen by reference to FIG. 3, when the parts have been assembled in the manner described, tangs 76 and 88 are immediately adjacent to each other between rollers 66 and 52. Tangs 78 and 90 are immediately adjacent to each other between the rollers 54 and 58. Tangs 80 and 92 are immediately adjacent to each other between the rollers 60 and 64.

The right-hand actuating assembly 26 is completed by a cover 100 and screw 102 which hold the parts in assembled relationship.

Figure 7:
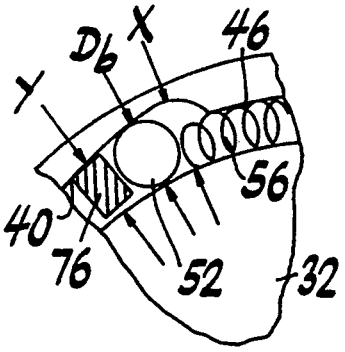
FIG. 7 is a fragmentary view illustrating the operation of our helmet visor operating mechanism.

In order to explain the mode of operation of our helmet visor operating assembly, reference is had to FIG. 7. As is indicated therein, the variable diameter surface 40 is provided with a smaller diameter surface portion at which the space between surface 40 and the outer surface of axle portion 32 is indicated as Y. Surface portion 40 also has a relatively larger diameter portion at which the distance between the surface 40 and the outer surface of axle portion 32 is indicated as X. The arrangement is such that the distance Y is less than the diameter $D_b$ of the roller 52 while the distance X is greater than the $D_b$ of the roller 52. In the absence of any force exerted on the actuator 70, spring 56 normally urges the roller 52 toward the reduced diameter portion of the surface 40 so that the roller 52 becomes wedged between surface 40 and the outer surface of axle portion 32. When actuator 70 is rotated in a clockwise direction, as viewed in FIG. 3, tang 76 moves the roller 52 toward the larger diameter portion of the surface 40 and out of wedging engagement between the surface 40 and outer surface of axle portion 32. In this relative position of the parts, a similar disengagement of all of the other rollers 54, 58, 60, 64 and 66 takes place and the outer visor 14 is free to move.

It will readily be appreciated that balls 54, 60 and 66 wedged between the outer surface of element 32 and the central portion of surfaces 40, 42 and 44 form a first means for locking the visor against movement toward lowered position while the balls 52, 58 and 64 wedged between the outer surface of element 32 and other central portions of surfaces 40, 42 and 44 form a second means for locking the visor against movement toward raised position. The first locking means is released by counter clock-wise movement of actuator 86 in FIG. 3 to cause tangs 88, 90 and 92 to move balls 66, 60 and 54 to larger diameter end portions of surfaces 40, 42 and 44. Similarly, the second locking means is released by clockwise movement of actuator 74 in FIG. 3 to cause tangs 76, 78 and 80 to move balls 52, 58 and 64 to other larger diameter outer portions of surfaces 40, 42 and 44. It will be appreciated further that while it is desirable to operate the actuators 74 and 76 together, it is possible to actuate them independently of each other and not release the other locking means.

The left-hand operating mechanism indicated generally by the reference character 104 is similar to mechanism 26. The left-hand arm 22 of the inner visor 16 is provided with a hub 106 which is received by an inner visor support portion 108 of an axle having an outer visor support portion 110. We employ any suitable means, such for example as screws 112, for securing the axle in operative position on the helmet shell 12.

The outer visor left-hand arm 18 is provided with a hub 114 which is received by the outer visor support portion 110 of the axle.

We mount an outer brake ring 116 in the hub 106 of arm 22 for rotation therewith. Brake ring 116 is identical to ring 38 in that it is provided with three equally spaced variable diameter inner surface portions separated by constant diameter inner surface portions. Further, in the same manner as is described hereinabove in connection with the mechanism 26, we provide the mechanism 104 with three pairs of rollers and three springs around the axle portion 108.

Mechanism 104 includes a first actuator 118 provided with an arm 120 to permit the actuator to be rotated and with a plurality of tangs including a tang 122. The assembly 104 includes a second actuator 124 assembled on axle portion 108 outboard of the brake ring 116. A cover 126 and screw 128 complete the assembly 104.

It will be appreciated from the structure just described that the actuator arms 74 and 86 of the assembly 26 as well as the corresponding actuators of the assembly 104, extend rearwardly of the helmet.

Figure 6:
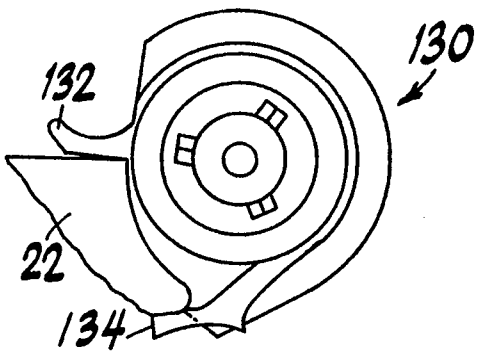
FIG. 6 is a fragmentary plan of an alternate embodiment of our helmet visor operating mechanism.
Figure 4:
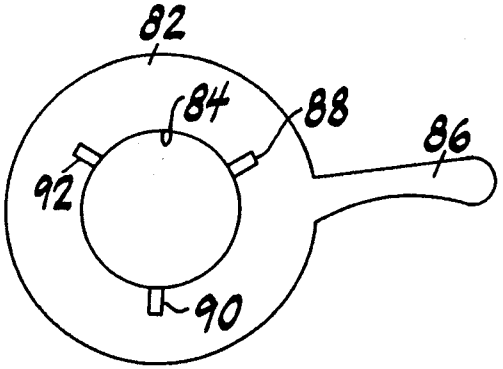
FIG. 4 is a plan of one of the actuating elements of the form of our helmet visor operating mechanism shown in FIG. 3.

Referring now to FIG. 6, we have shown an alternate embodiment of our helmet visor operating assembly indicated generally by the reference character 130 wherein the actuators 132 and 134 extend forwardly of the helmet.

In operation of our helmet visor operating system, the springs 56, 62 and 68 normally urge the rollers of the pairs of rollers 52 and 54, 58 and 60, and 64 and 66, away from each other and toward the reduced diameter portions of the surfaces 40, 42 and 44, so that the helmet visors 14 and 16 are locked against movement. When it is desired to move the outer visor, for example, the wearer squeezes the two arms 74 and 86 toward each other. This results in a clockwise movement of the tangs 76, 78 and 80 and a counterclockwise movement of the tangs 88, 90 and 92, as viewed in FIG. 3. When this occurs, tangs 76 and 88 engage the respective rollers 52 and 66 to move the rollers out of a wedged condition between the outer surface of axle portion 32 and the smaller diameter surface portion of surface 40 and toward the relatively larger diameter portions of surface 40. Ultimately, roller 52 engages the shoulder between surfaces 40 and 46, while roller 66 engages the shoulder between surfaces 40 and 50. In a similar manner, tangs 78 and 90 move rollers 54 and 58 away from each other and into engagement with the respective shoulders between surfaces 42 and 46 and between surfaces 42 and 48. Tangs 80 and 92 move rollers 64 and 60 away from each other and into engagement with the respective shoulders between surfaces 44 and 48 and between surfaces 44 and 50.

It will be appreciated that in operation of our mechanism, all of the rollers are pushed concomitantly and all parts are unlocked. All the frictional locking force is removed so that there is no tendency to drag along the visor in the course of the unlocking operation. Moreover, once the rollers have been moved out of wedged conditions and into engagement with the shoulders, movement of the visor is entirely and positively under the control of the wearer. Thus, the need for any auxiliary elements, such as the drag rings of the Hedges et al application, is eliminated.

If the user wishes to move the visor up, after having squeezed the arms 74 and 86 together, he moves them both in a clockwise direction as viewed in FIG. 3. Alternatively, if the visor is to be moved downward after the arms 74 and 86 are squeezed together, they are moved as a unit in a counterclockwise direction as viewed in FIG. 3.

When the desired position of the visor has been reached, the finger pieces or arms 74 and 86 are released. When that occurs, springs 56, 62 and 68 move the pairs of rollers 52 and 54, 58 and 60, and 64 and 66, away from each other toward the reduced diameter portions of their associated surfaces 40, 42, or 44, so that the visor is again locked in position. At the same time, the rollers engage their associated tangs to move them back to their initial positions together with the arms 74 and 86 on the actuator 70 and 82.

It will be seen that we have accomplished the objects of our invention. We have provided a helmet visor operating assembly which overcomes the defects of visor operating assemblies of the prior art. Our assembly affords easy release of the visor from its locked position under all conditions of use. It does not require any auxiliary means for ensuring smooth operation. It is simple in construction and in operation for the results achieved thereby.

It will be seen that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A helmet and visor assembly including in combination a helmet shell, a visor, means mounting said visor on said shell for rotary movement around an axis between a raised position and a lowered position, first means for locking said visor against movement toward said lowered position, second means for locking said visor against movement toward said raised position and means comprising respective arms mounted for rotary movement around said axis for concomitantly releasing said first and second locking means, said locking means comprising means for biasing said arms to positions at which said arms are relatively remote from each other, said locking means being released in response to movement of said arms from said relatively remote positions to relatively adjacent positions.

2. An assembly as in claim 1 in which said arms extend rearwardly of said helmet shell.

3. An assembly as in claim 1 in which said arms extend forwardly of said helmet shell.

4. An assembly as in claim 1 including means responsive to movement of said arms together around said axis for moving said visor.

5. A helmet and visor assembly including in combination a helmet shell, an axle on said shell, means mounting said visor on said axle for movement in one direction to a raised position and in the opposite direction to a lowered position, said mounting means comprising a brake ring carried by said visor and surrounding said axle, said axle and said ring being configured to provide first spaces therebetween having a relatively larger radial dimension and adjacent second spaces therebetween having a relatively smaller radial dimension when said ring is generally coaxial with said axle, a pair of rolling elements disposed between said ring and said axle, each of said rolling elements having a diameter less than said larger radial dimension and greater than said smaller radial dimension, first means for urging one of said rolling elements away from one of said larger dimension spaces and toward one of said smaller dimension spaces to lock said visor against movement in the direction opposite to said one direction, second means for urging the other of said rolling elements from another of said larger dimension spaces to another of said smaller dimension spaces to lock said visor against movement in said one direction, a first actuator for moving said one rolling element away from said one smaller dimension space and towards said one larger diameter space and a second actuator for moving the other of said rolling elements from said other smaller dimension space to said other larger dimension space.

6. An assembly as in claim 5 in which said urging means urge said rolling elements in opposite directions.

7. An assembly as in claim 6 in which said actuators are mounted for rotary movement around said axle.

8. An assembly as in claim 7 in which said actuators comprise respective tangs extending into the space between said ring and said axle.

9. An assembly as in claim 8 in which said tangs are disposed between said rolling elements.

10. An assembly as in claim 9 in which said actuators comprise respective operating arms extending outwardly from said axle.

11. An assembly as in claim 10 in which said axle is generally cylindrical and in which said outer ring is formed with an inner surface portion which varies from a relatively larger diameter to a relatively smaller diameter and back to said relatively larger diameter to form said spaces.

12. An assembly as in claim 11 in which said first and second actuators are disposed on opposite sides of said ring whereby the tangs of one of said actuators extend in one direction into said spaces and the tangs of the other actuator extend in the opposite direction into said spaces.

13. An assembly as in claim 12 in which said arms extend rearwardly of said shell.

14. An assembly as in claim 12 in which said arms extend forwardly of said shell.

* * * * *